US007263743B2

(12) United States Patent
Holsten

(10) Patent No.: US 7,263,743 B2
(45) Date of Patent: Sep. 4, 2007

(54) MOTOR MOUNT ASSEMBLY

(75) Inventor: Stuart V Holsten, O'Fallon, MO (US)

(73) Assignee: Emerson Electric Co., St. Louis, MO (US)

( * ) Notice: Subject to any disclaimer, the term of this patent is extended or adjusted under 35 U.S.C. 154(b) by 687 days.

(21) Appl. No.: 10/707,506

(22) Filed: Dec. 18, 2003

(65) Prior Publication Data

US 2005/0132526 A1 Jun. 23, 2005

(51) Int. Cl.
*A47L 9/22* (2006.01)

(52) U.S. Cl. ..... 15/326; 15/327.6; 15/353; 15/412

(58) Field of Classification Search ..... 15/326, 15/327.6, 353, 412
See application file for complete search history.

(56) References Cited

U.S. PATENT DOCUMENTS

| | | | | |
|---|---|---|---|---|
| 5,353,469 | A * | 10/1994 | Fellhauer | 15/326 |
| 5,813,085 | A * | 9/1998 | Fritz et al. | 15/314 |
| 6,508,867 | B2 * | 1/2003 | Schoenewald et al. | 96/333 |
| 6,757,935 | B1 * | 7/2004 | Sjoberg | 15/413 |

* cited by examiner

*Primary Examiner*—Theresa T. Snider
(74) *Attorney, Agent, or Firm*—Locke Liddell & Sapp PLLC

(57) ABSTRACT

A motor mounting assembly includes a motor mount member having a first and second generally opposing sides. A generally U-shaped channel is formed in the second side of the motor mount member extending around its periphery to form a lip extending from the first side of the motor mounting member. The U-shaped channel allows slight movement of the motor mount member in a radial direction to absorb vibrations from a motor attached thereto.

17 Claims, 2 Drawing Sheets

MOTOR MOUNT ASSEMBLY

BACKGROUND

1. Field of the Disclosure

This disclosure relates generally to motor mounting structures, and more particularly, to a motor mounting assembly that dampens motor vibrations.

2. Description of Related Art

Appliances and tools driven by electric motors typically have a motor mounting structure that rigidly attaches the motor to the appliance itself. For example, wet/dry vacuum appliances often have the motor attached directly to the appliance lid via fasteners such as screws or bolts. Further, the junction of the motor mount area of the lid and the sides of the lid typically includes stiff ribs joining these areas together.

When mounted in this manner, the motor directly abuts the lid, creating a solid mounting position. Additional benefits of such a mounting arrangement include easily locating the motor during the appliance assembly process and creating a motor-to-lid water seal due to the direct part-to-part contact. However, motor vibrations are transferred to the lid due to the motor mounting and construction of the lid itself.

Prior art attempts to dampen vibration and reduce the noise associated with such vibrations have been largely unsatisfactory. For example, rubber parts and/or seals have been added to separate the motor from direct contact with the lid and absorb motor vibrations. This results in undesirable additional parts and associated increased material and labor costs. Moreover, in applications such as wet/dry vacuums that require the motor be water sealed, additional parts may be required to provide the water seal. Still further, when the motor is mounted such that it does not directly seal against the lid, additional structure may be necessary to provide a vacuum seal to achieve the desired appliance performance.

The present application addresses shortcomings associated with the prior art.

SUMMARY

Among other things, this disclosure concerns a motor mounting assembly that dampens vibration to reduce motor noise from the motor. The motor mounting assembly includes a motor mount member having first and second generally opposing sides. The motor mount member may have an opening therethrough to receive the shaft of a motor attached to the assembly. A generally U-shaped channel is formed in the second side of the motor mount member extending around its periphery to form a lip extending from the first side of the motor mounting member. The U-shaped channel allows slight movement of the motor mount member in a radial direction to absorb vibrations from a motor attached thereto.

The motor mounting assembly may be used to attach a motor to a vacuum appliance, such as a wet/dry vacuum. For instance, the appliance may include a collection drum, with the motor being operable to create a vacuum in the collection drum to suck debris or liquids into the drum. A lid is affixed to the collection drum with the motor mount member having the motor attached thereto. The motor mount member has first and second generally opposing sides. A generally U-shaped channel is formed in the second side of the motor mount member extending around the periphery thereof forming a lip extending from the first side of the motor mount member. The U-shaped channel allows slight movement of the motor mount member to absorb vibrations from the motor, rather than transfer the vibrations to the lid, and vacuum appliance.

BRIEF DESCRIPTION OF DRAWINGS

Other objects and advantages of the invention will become apparent upon reading the following detailed description and upon reference to the drawings in which.

Figure 1:
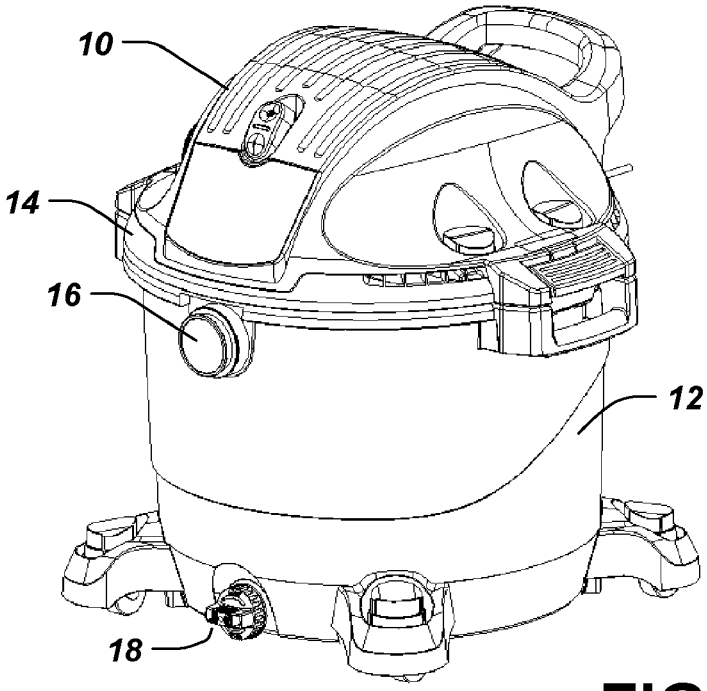
FIG. 1 is a perspective view of a wet/dry vacuum employing a motor mounting assembly in accordance with the present disclosure.

While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

DETAILED DESCRIPTION

Illustrative embodiments of the invention are described below. In the interest of clarity, not all features of an actual implementation are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

FIG. 1 illustrates a wet/dry vacuum 10 using a motor mount assembly as disclosed herein. The vacuum 10 includes a collection drum 12 and a lid 14 removably attached to the collection drum such that the lid 14 can be removed to empty debris or liquids contained therein. As with known wet/dry vacuums, a motor is attached to the inside portion of the lid 14 of the vacuum 10, which is operable to create the vacuum inside the collection drum 12 to draw debris or liquid into the collection drum 12 through an inlet port 16. The collection drum further includes a drain 18 so that liquid can be emptied from the collection drum 12 without removing the lid 14.

Figure 2:
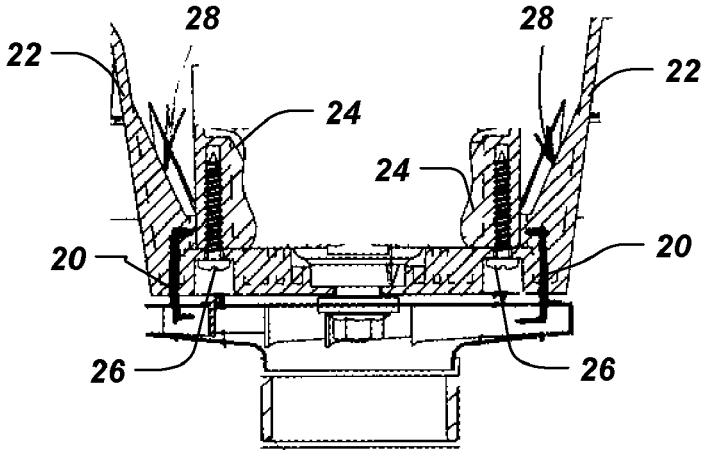
FIG. 2 (prior art)
FIG. 2 is a sectional view of a prior art motor mounting arrangement.

FIG. 2 is a sectional view showing a prior art motor mounting arrangement and portions of the motor used in a wet/dry vacuum. A mounting portion 20 has side walls 22 extending therefrom. The motor 24 is attached directly to the mounting portion 20 by screws 26 extending through openings in the mounting portion 20. The connection of the mounting portion 20 to the side walls 22 is rigidly reinforced by connecting ribs 28. As noted in the background section above, such mounting arrangements solidly connect the motor 24 directly to the mounting portion 20. This simplifies assembly by making it easy to properly position the motor 24, and it provides a motor-to-lid water seal. However, because the mounting portion 20 and the side walls 22 are a rigid unit with the motor 24 directly mounted thereto, vibrations from the motor 24 are transferred to the lid.

Figure 3:
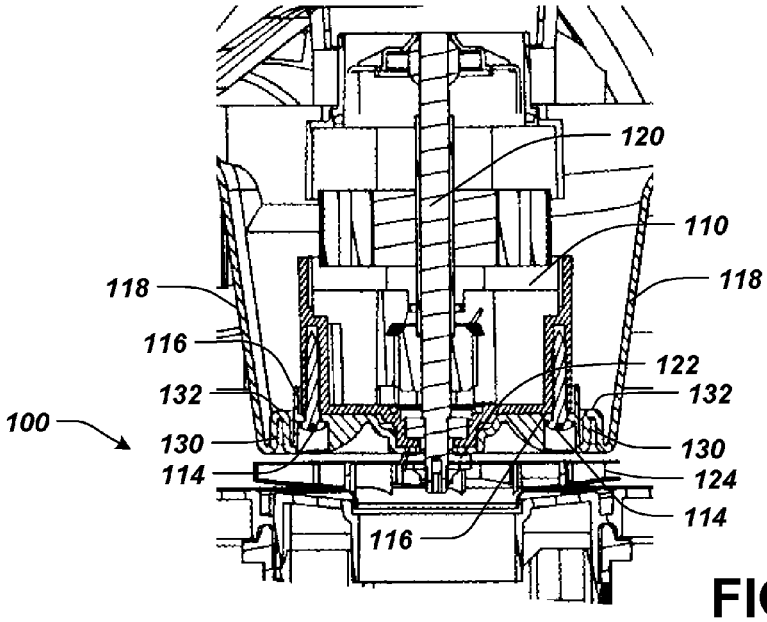
FIG. 3 is a sectional view of a motor and a mounting assembly in accordance with the present disclosure.
Figure 4:
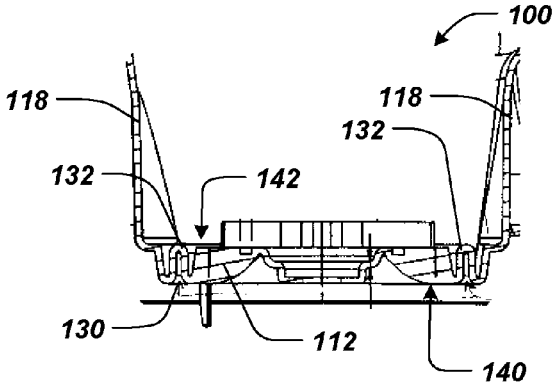
FIG. 4 is a sectional view of portions of the motor mounting assembly shown in FIG. 3.
Figure 5:
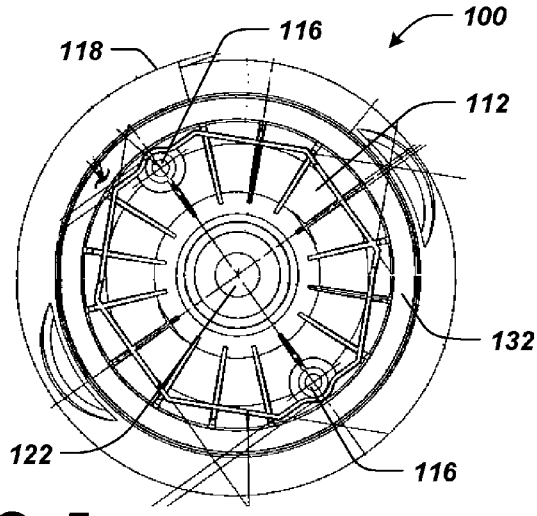
FIG. 5 is an end view of portions of the motor mounting assembly shown in FIGS. 3 and 4.

FIGS. 3-5 illustrate an exemplary mounting assembly in accordance with aspects of the present invention. The mounting assembly is disclosed herein in conjunction with the wet/dry vacuum 12; however, it would be a routine undertaking for one skilled in the art having the benefit of this disclosure to implement the motor mounting assembly in other types of appliances or machines.

As noted above, the wet/dry vacuum 10 shown in FIG. 1 includes a motor to create the vacuum in the collection drum 12. FIG. 3 is a sectional view of a motor mounting assembly 100 having a motor 110 connected thereto. The motor 110 is attached to a mounting member 112 by a plurality of fasteners, such as screws 114, extending through openings 116 in the mounting member 112. A side wall 118 extends from the mounting member 112. The motor 110 includes a shaft 120 that extends through an opening 122 in the mounting member 112. A blower wheel 124 is attached to the end of the shaft 120 such that the blower wheel 124 is situated on the side of the mounting member 112 opposite the side to which the motor 110 is attached. The motor 110 rotates the blower wheel 124 to create the required vacuum in the collection drum 12.

FIG. 4 shows the mounting assembly 100 without the motor 110 attached. The mounting member 112 defines a generally U-shaped channel 130 therein. As shown in FIGS. 3 and 4, the channel 130 is formed in the bottom side 140 of the mounting member 112 (the surface opposite the motor 110) so as to form a lip 132 protruding from the upper side 142 of the mounting member 112 (towards the motor 110). As shown in FIG. 5, the lip 132 extends around the entire periphery of the mounting member 112, such that it surrounds the motor 110.

In exemplary embodiments, the mounting assembly 100 is formed from plastic, such as polypropylene, with a wall thickness of about 0.100 inch. The channel 130 extends about 0.5 inch into the bottom side 140 of the mounting member 112, so the lip 132 extends about 0.5 inch from the upper side 142. The channel 130 allows slight movement of the mounting member 112 in the radial direction (side-to-side as shown in FIGS. 3 and 4), as the channel 130 in the bottom surface 140 opens and closes slightly. The shape of the channel 130 generally does not allow movement in the axial direction (up and down as shown in FIGS. 3 and 4), providing good control of the location of the motor 110. Since the mounting member 112 can move slightly, it can absorb some of the vibrations caused by the motor 110, rather than transferring the vibrations to the side wall 118 and the remaining parts of the lid 14 and the vacuum appliance 10 itself.

Moreover, the channel 130, and thus the lip 132, extend completely around the periphery of the mounting member 112, surrounding the motor 110. Accordingly, there is no opening that would allow liquids to reach the motor 110, or allow air leaks that would decrease the vacuum created in the collection drum 14 and reduce performance of the appliance 10. Since the channel 130 and lip 132 are formed as part of the mounting surface, no additional parts are required for vibration damping purposes. This keeps the part count at a minimum and simplifies assembly procedures.

Illustrative embodiments of the invention are described below. In the interest of clarity, not all features of an actual implementation are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nonetheless be a routine undertaking for those of ordinary skill in the art having the benefit of this disclosure.

The particular embodiments disclosed above are illustrative only, as the invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular embodiments disclosed above may be altered or modified and all such variations are considered within the scope and spirit of the invention. Accordingly, the protection sought herein is as set forth in the claims below.

The invention claimed is:

1. A vacuum appliance, comprising:

a collection drum;

a motor operable to create a vacuum in the collection drum;

a lid removably attached to the collection drum, the lid having a motor mount member with the motor attached thereto, the motor mount member having a wall with first and second generally opposing sides; and a generally U-shaped channel formed in the first side of the wall extending around the periphery of the motor mount member to form a lip protruding from the second side of the wall towards the motor, the U-shaped channel allowing slight movement of the motor mount member to absorb vibrations from the motor, wherein the lip substantially surrounds the motor.

2. The vacuum appliance of claim 1, wherein the motor is attached to the first side of the wall.

3. The vacuum appliance of claim 2, wherein the motor mount member defines an opening through which a shaft extends, such that the blower is situated adjacent the first side of the wall.

4. The vacuum appliance of claim 1, further comprising a blower wheel, wherein the motor includes a shaft having the blower wheel attached thereto.

5. The vacuum appliance of claim 1, further comprising a plurality of fasteners extending through the motor mount member to attach the motor to the motor mount member.

6. The vacuum appliance of claim 5, wherein the fasteners comprise screws.

7. The vacuum appliance of claim 1, wherein the collection drum includes a drain opening extending therethrough.

8. A motor mount assembly, comprising:

a motor mount member having a wall with first and second generally opposing sides; and a generally U-shaped channel formed in the first side of the wall extending around the periphery of the motor mount member to form a lip protruding from the second side of the wall in the direction of the second side of the wall, wherein the U-shaped channel allows slight movement of the motor mount member in a radial direction.

9. The motor mount assembly of claim 8, wherein the second side of the wall is adapted to have a motor attached thereto.

10. The motor mount assembly of claim 8, wherein the motor mount member defines an opening extending therethrough for receiving a motor shaft.

11. The motor mount assembly of claim 8, wherein the motor mount member defines a plurality of openings therethrough for receiving fasteners for attaching the motor to the motor mount member.

12. A method of dampening vibrations of a motor; comprising:

providing a motor mount member having a wall with first and second generally opposing sides and a generally U-shaped channel formed in the first side of the wall to form a lip protruding from the second side of the wall, the lip extending around the periphery of the motor mount member; and attaching a motor to the motor mount member, wherein the U-shaped channel allows slight movement of the motor mount member to absorb vibrations from the motor.

13. The method of claim 12, wherein attaching the motor to the motor mount member comprises attaching the motor to the second side of the wall.

14. The method of claim 12, wherein attaching the motor to the motor mount member includes attaching the motor such that the lip generally surrounds the motor.

15. The method of claim 12, wherein the motor includes a shaft, and wherein attaching the motor to the motor mount member includes extending a portion of the shaft through an opening in the motor mount member.

16. The method of claim 15, further comprising attaching a blower wheel to the portion of the shaft extending through the opening such that the blower wheel is situated adjacent the first side of the wall.

17. The method of claim 12, wherein attaching the motor to the motor mount member includes extending fasteners through openings defined in the motor mount member and attaching the fasteners to the motor.

* * * * *